US005082763A

United States Patent [19]

Kojima et al.

[11] Patent Number: 5,082,763

[45] Date of Patent: Jan. 21, 1992

[54] HEAT DEVELOPABLE PHOTOSENSITIVE MATERIAL

[75] Inventors: Tetsuro Kojima; Tomoyuki Koide, both of Kanagawa, Japan

[73] Assignee: Fuji Photo Film Co., Ltd., Kanagawa, Japan

[21] Appl. No.: 664,506

[22] Filed: Mar. 5, 1991

Related U.S. Application Data

[63] Continuation of Ser. No. 389,389, Aug. 4, 1989, abandoned.

[30] Foreign Application Priority Data

Aug. 5, 1988 [JP] Japan ..... 63-195776

[51] Int. Cl.[5] ..... G03C 5/54; G03C 1/34

[52] U.S. Cl. ..... 430/353; 430/203; 430/351; 430/611; 430/617

[58] Field of Search ..... 430/203, 611, 617, 351, 430/353

[56] References Cited

U.S. PATENT DOCUMENTS

| | | | |
|---|---|---|---|
| 4,451,561 | 5/1984 | Hirabayashi et al. | 430/611 |
| 4,657,847 | 4/1987 | Ikeda et al. | 430/611 |
| 4,696,887 | 9/1987 | Sato et al. | 430/203 |
| 4,696,894 | 9/1987 | Deguchi et al. | 430/611 |
| 4,713,319 | 12/1987 | Acno et al. | 430/203 |
| 4,719,168 | 1/1988 | Nakamura et al. | 430/203 |
| 4,740,454 | 4/1988 | Deguchi et al. | 430/611 |
| 4,772,546 | 9/1988 | Deguchi et al. | 430/611 |
| 4,840,882 | 6/1989 | Iwagaki et al. | 430/203 |
| 4,859,580 | 8/1989 | Aono et al. | 430/203 |
| 4,877,722 | 10/1989 | Peters et al. | 430/203 |
| 4,886,738 | 12/1989 | Deguchi et al. | 430/611 |
| 4,966,833 | 10/1990 | Inoue | 430/611 |

FOREIGN PATENT DOCUMENTS

| | | |
|---|---|---|
| 0175148 | 3/1986 | European Pat. Off. . |
| 0218385 | 4/1987 | European Pat. Off. . |
| 0246624 | 11/1987 | European Pat. Off. . |

*Primary Examiner*—Richard L. Schilling
*Attorney, Agent, or Firm*—Sughrue, Mion, Zinn, Macpeak & Seas

[57] ABSTRACT

A heat developable photosensitive material comprising a support having thereon at least one photosensitive silver halide emulsion layer, which contains at least one compound selected from those represented by the following general formulae (I) and (II) to acquire a high S/N ratio and high sensitivity:

(I)

(II)

wherein R represents an alkylene group, an alkenylene group, an aralkylene group or an arylene group, which each may be substituted; Y represents $R_1$, $R_2$, $R_3$, $R_4$, $R_5$, $R_6$, $R_7$, $R_8$, $R_9$ and $R_{10}$ each represents a hydrogen atom, or a substituted or unsubstituted alkyl, aryl, alkenyl or aralkyl group; X represents R′ represents a hydrogen atom, or a substituted or unsubstituted alkyl or alkenyl group; R″ represents a hydrogen atom, or a substitutive group therefor; M represents a hydrogen atom, an alkali metal ion, an ammonium group, or a group capable of being cleaved under an alkaline condition; n represents 0 or 1; m represents 1 or 2; l represents 4–m; Z represents a substituted or unsubstituted amino, quaternary ammonium, sulfonyl, carbamoyl, sulfamoyl, carbonamido, sulfonamido, ureido, alkylthio, alkoxy or heterocyclic group; X′ represents —O—, —S—S, or —NH—; Y′ represents $R_{11}$, $R_{12}$, $R_{13}$, $R_{14}$, $R_{15}$, $R_{16}$, $R_{17}$ and $R_{18}$ each has the same meaning as $R_1$ to $R_{10}$.

22 Claims, No Drawings

HEAT DEVELOPABLE PHOTOSENSITIVE MATERIAL

This is a continuation of application Ser. No. 07/389,389 filed Aug. 4, 1989, now abandoned.

FIELD OF THE INVENTION

This invention relates to a heat developable photosensitive material and, more particularly, to a heat developable photosensitive material which is excellent in S/N ratio (the maximum image density to the minimum density) and has high sensitivity.

BACKGROUND OF THE INVENTION

Heat developable photosensitive materials which utilize silver halides as a photosensitive component are well-known in the field of this art, and described, e.g., in *Shashin Kogaku no Kiso* (which means fundamentals of photographic engineering), volume "Higinen Shashin" (which means "Nonsilver Photography"), pages 242 to 255, Corona Co. (1982); *Eizo Jouho* (which means image information), page 40 (April 1978); Nebletts, *Handbook of Photography and Reprography*, 7th Ed., pages 32 to 33, Van Norstrand Reinhold Company; U.S. Pat. Nos. 3,152,904, 3,301,678, 3,392,020 and 3,457,075; British Patents 1,131,108 and 1,167,777; and *Research Disclosure* (which is abbreviated as RD, hereinafter), pages 9 to 15 (June 1978).

Many methods for forming color images through heat development have been proposed.

For instance, methods of forming color images by binding couplers to the oxidation product of the developing agents which are produced through the reduction of silver halides are disclosed in U.S. Pat. Nos. 3,531,286, 3,761,270 and 4,021,240; Belgian Patent 802,519, RD-13742, and so on.

In addition, methods of forming positive dye images through heat development according to the silver dye bleach process utilizing silver halides are disclosed in U.S. Pat. No. 4,235,957, RD-14433, RD-15227, and so on.

Moreover, there have been proposed methods comprising a step of imagewise forming or releasing diffusible dyes from dye-providing compounds in accompanied with the heat development of silver halides, and a step of transferring the formed or released diffusible dyes into a mordant-containing dye-fixing element with the aid of a solvent such as water or the like, into a dye-fixing element using a high boiling organic solvent or a hydrophilic thermal solvent incorporated in the dye-fixing element, or into a dye-receiving element such as a support or so on when the mobility of the dyes originates from thermal diffusibility or sublimability. In those methods, either dye image, negative or positive to original ones, can be obtained by changing dye-providing compounds and/or silver halides to be used in kind (as disclosed in U.S. Pat. Nos. 4,463,079, 4,474,867, 4,478,927, 4,507,380, 4,500,626 and 4,483,914, JP-A-58-149046 (the term "JP-A" as used herein means an "unexamined published Japanese patent application"), JP-A-58-149047, JP-A-59-152440, JP-A-59-154445, JP-A-59-165054, JP-A-59- 180548, JP-A-59-168439, JP-A-59-174832, JP-A-59-174833, JP-A-59-174834, JP-A-59-174835, JP-A-62-65038, JP-A-61-23245, EP-A-210660, EP-A-220746, and so on).

However, the above-described heat developable photosensitive materials are development-processed under heating to high temperatures, so they have generated fog (or lowering of Dmax in photosensitive materials of the kind which make a positive response to a positive original) to a considerable extent, in contrast to ordinary photosensitive materials to undergo development-processing in the vicinity of room temperature. That is, They have been hard to provide photographs excellent in image distinguishability (with high S/N).

Although hydroxytetrazaindenes, benzotriazoles and the like are known to be effective as antifoggant in ordinary photosensitive materials to be developed in the vicinity of room temperature, they have failed in achieving the end desired and, what is worse, have caused a lowering of sensitivity when applied to heat developable photosensitive materials.

Also, the desired end has not been achieved with antifoggant-containing heat developable photosensitive materials disclosed in JP-A-59-168442, JP-A-59-111636, JP-A-59-177550, JP-A-60-168545, JP-A-60-180199, JP-A-60-180563, JP-A-61-53633, JP-A-62-78554, JP-A-62-123456, JP-A-63-133144, and so on.

SUMMARY OF THE INVENTION

Therefore, an object of this invention is to provide a heat developable photosensitive material which is excellent in image distinguishability (S/N ratio), as well as sensitivity.

In order to achieve the above-described object, a heat developable photosensitive material of this invention has at least one photosensitive silver halide emulsion layer on a support, and contains at least one compound selected from those represented by the following general formulae (I) and (II):

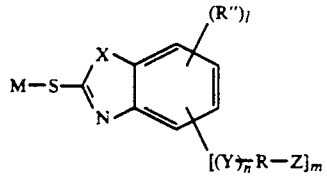

(I)

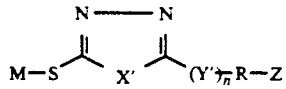

(II)

wherein R represents an alkylene group, an alkenylene group, and aralkylene group or an arylene group, which each may be substituted; Y represents

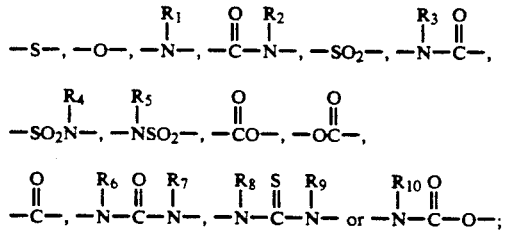

$R_1$, $R_2$, $R_3$, $R_4$, $R_5$, $R_6$, $R_7$, $R_8$, $R_9$ and $R_{10}$ each represents a hydrogen atom, or a substituted or unsubstituted alkyl, aryl, alkenyl or aralkyl group; X represents

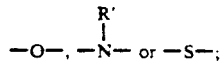

R′ represents a hydrogen atom, or a substituted or unsubstituted alkyl or alkenyl group; R″ represents a hydrogen atom, or a substitutive group therefore; M represents a hydrogen atom, an alkali metal ion, an ammonium group, or a group capable of being cleaved under an alkaline condition; n represents 0 or 1; m represents 1 or 2; l represents 4-m; Z represents a substituted or unsubstituted amino, quaternary ammonium, sulfonyl, carbamoyl, sulfamoyl, carbonamido, sulfonamido, ureido, alkylthio, alkoxy or heterocyclic group; X′ represents —O—, —S—, or —NH—; Y′ represents

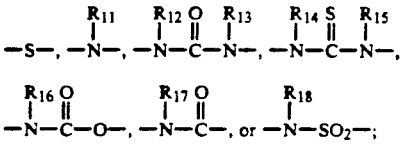

$R_{11}$, $R_{12}$, $R_{13}$, $R_{14}$, $R_{15}$, $R_{16}$, $R_{17}$ and $R_{18}$ each has the same meaning as $R_1$ to $R_{10}$.

DETAILED DESCRIPTION OF THE INVENTION

In, more detail, R represents a straight-chain or branched alkylene group (e.g., methylene, ethylene, propylene, butylene, hexylene, 1-methylethylene), a straight-chain or branched alkenylene group (e.g., vinylene, 1-methylvinylene), a straight-chain or branched aralkylene group (e.g., benzylidene), or an arylene group (e.g., phenylene, naphthylene). These groups each may have a substituent, such as an alkoxy group, a halogen atom or so on.

$R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (e.g., methyl, ethyl, propyl, 2-dimethylaminoethyl), a substituted or unsubstituted aryl group (e.g., phenyl, 2-methylphenyl), a substituted or unsubstituted alkenyl group (e.g., propenyl, 1-methylvinyl), or a substituted or unsubstituted aralkyl group (e.g., benzyl, phenetyl).

R′ represents a hydrogen atom, or a substituted or unsubstituted alkyl group (e.g., methyl, ethyl, propyl, 2-dimethylaminoethyl, 2-imidazolylethyl, 2-dimethylaminopropyl), substituted or unsubstituted alkenyl group (e.g., propenyl, 1-methylvinyl).

R″ represents a hydrogen atom, or a group by which hydrogen atom can be replaced, with specific examples including a halogen atom (e.g., fluorine, chlorine, bromine), a substituted or unsubstituted alkyl group containing 1 to 6 carbon atoms (e.g., methyl, trifluoromethyl, ethyl, n-butyl), a substituted or unsubstituted aryl group containing 6 to 12 carbon atoms (e.g., phenyl, 4-methylphenyl), a substituted or unsubstituted alkoxy group containing 1 to 6 carbon atoms (e.g., methoxy, ethoxy), a substituted or unsubstituted aryloxy group containing 6 to 12 carbon atoms (e.g., phenoxy, 4-methylphenoxy), a sulfonyl group containing 1 to 12 carbon atoms (e.g., methanesulfonyl, p-toluenesulfonyl), a sulfonamido group containing 1 to 12 carbon atoms (e.g., methanesulfonamido, p-toluene-sulfonamido, ethanesulfonamido), a sulfamoyl group containing 1 to 12 carbon atoms (e.g., diethylsulfamoyl, phenylsulfamoyl), a carbamoyl group containing 1 to 12 carbon atoms (e.g., unsubstituted carbamolyl, methylcarbamoyl, phenylcarbamoyl), an amido group containing 2 to 12 carbon atoms (e.g., acetamido, benzamido), an ureido group containing 1 to 12 carbon atoms (e.g., unsubstituted ureido, 3-methylurido, 3-phenylureido), an aryloxy- or alkoxy-carbonyl group containing 2 to 12 carbon atoms (e.g., methoxycarbonyl, phenoxycarbonyl), an aryloxy- or alkoxy-carbonylamino group containing 2 to 12 carbon atoms (e.g., methoxycarbonylamino, phenoxy-carbonylamino), cyan group, and so on.

M represents a hydrogen atom, an alkali metal ion (e.g., sodium, potassium), an ammonium group (e.g., trimethylammonium chloride, dimethylbenzylammonium chloride), or a group capable of being converted to H or an alkali metal under an alkaline condition (e.g., acetyl, cyanoethyl, methanesulfonylethyl).

Z represents a substituted or unsubstituted amino group (including the salt form thereof, e.g., amino group, hydrochloride of amino group, methylamino group, dimethylamino group, hydrochloride of dimethylamino group, dibutylamino group, dipropylamino group, N-dimethylaminoethyl-N-methylamino group), a substituted or unsubstituted quaternary ammoniumyl group (e.g., trimethylammoniumyl chloride, dimethylbenzylammoniumyl chloride), a substituted or unsubstituted sulfonyl group (e.g., methanesulfonyl, ethanesulfonyl, p-toluene-sulfonyl), a substituted or unsubstituted carbamoyl group (e.g., unsubstituted carbamoyl, methylcarbamoyl), a substituted or unsubstituted sulfamoyl group (e.g., unsubstituted sulfamoyl, methylsulfamoyl), a substituted or unsubstituted carbonamido group (e.g., acetamido, benzamido, and alkylcarbonamido groups substituted by an amino group, such as 3-dimethylaminopropionamido), a substituted or unsubstituted sulfonamido group (e.g., methanesulfonamido, benzenesulfonamido), a substituted or unsubstituted ureido group (e.g., unsubstituted ureido, methylureido, ethylureido), substituted or unsubstituted alkylthio group (e.g., methylthio, and amino-substituted alkylthio such as 2-N,N-dimethylaminoethylthio), a substituted or unsubstituted alkoxy group (e.g., methoxy, ethoxy, dimethylaminoethoxy), and a substituted or unsubstituted heterocyclic group (e.g., nitrogen-containing heterocyclic such as 1-morpholino, 1-piperizino, 2-pyridyl, 4-pyridyl, 1-pyrazolyl, 1-imidazolyl, 2-imidazolyl, and 2-tetrahydrofuryl).

Each group represented by Z may further be substituted by an arbitrary combination of R and Z.

In the general formula (I), it is desirable that R should be a substituted or unsubstituted alkylene, Y should be all of $R_2$, $R_3$, $R_5$, $R_6$ and $R_7$ should be a hydrogen atom, X should be —S— or —O—, R″ should be a hydrogen atom, a halogen atom, an alkyl group or an alkoxy group, M should be a hydrogen atom, a sodium ion, a potassium ion or an ammonium group, n, m and l each should be 1, and Z should be a substituted or unsubstituted amino group or a salt thereof, an alkylthio group substituted by an amino group, or a nitrogen-containing heterocyclic group.

In the general formula (II), it is desirable that R should be a substituted or unsubstituted alkylene group, Y′ should be $$-S-,\ -\overset{R_{14}}{\overset{|}{N}}-\overset{O}{\overset{\|}{C}}-\overset{R_{15}}{\overset{|}{N}}-,$$

$R_{14}$ and $R_{15}$ should be both a hydrogen atom, X' should be —S— or —O—, M should be a hydrogen atom, a sodium ion, a potassium ion or an ammonium group, n should be 1, and Z should be a substituted or unsubstituted amino group, a salt thereof, an alkylthio group, or a heterocyclic group.

The compounds represented by the general formula (I) is preferable to those represented by the general formula (II).

Among them, those containing a moiety of formula $$-\overset{R_6}{\overset{|}{N}}-\overset{O}{\overset{\|}{C}}-\overset{R_7}{\overset{|}{N}}-$$

as Y, and as Z a substituted or unsubstituted amino group or a salt thereof, or an alkylthio group substituted by an amino group are preferred over others.

Specific examples of compounds represented by the general formulae (I) and (II) are illustrated below. However, this invention should not be construed as being limited to these examples.

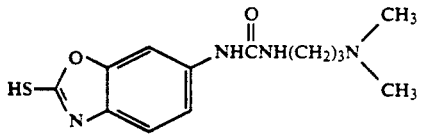
(I-1)

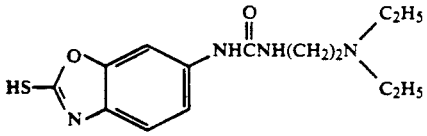
(I-2)

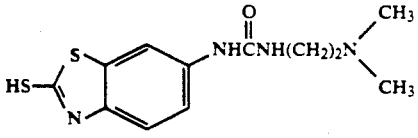
(I-3)

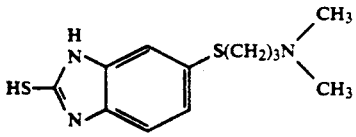
(I-4)

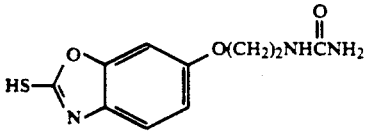
(I-5)

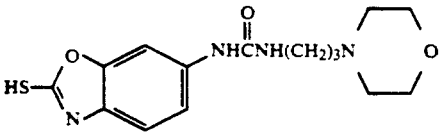
(I-6)

-continued

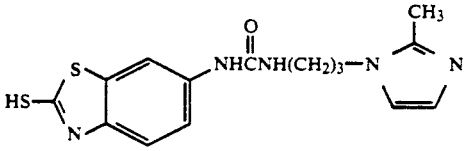
(I-7)

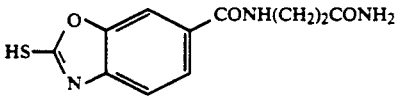
(I-8)

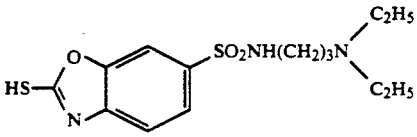
(I-9)

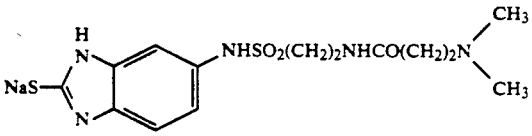
(I-10)

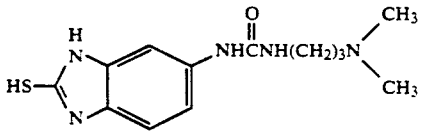
(I-11)

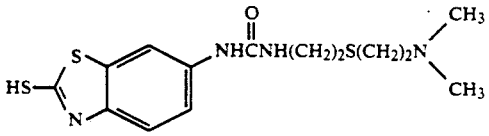
(I-12)

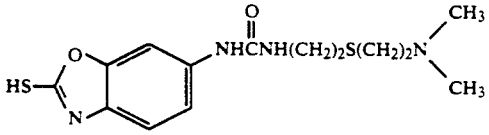
(I-13)

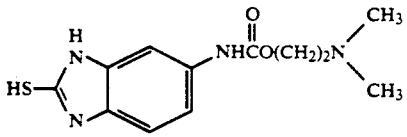
(I-14)

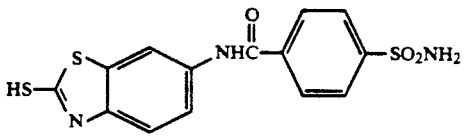
(I-15)

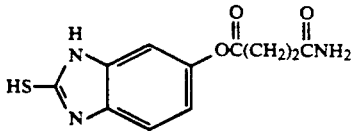
(I-16)

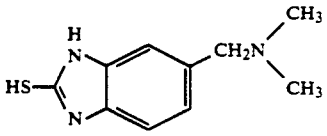
(I-17)

-continued
(I-18)
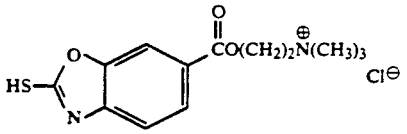
(I-19)
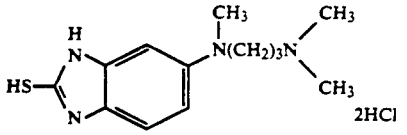
(I-20)
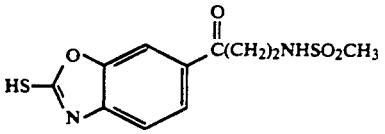
(I-21)
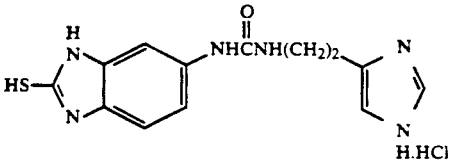
(I-22)
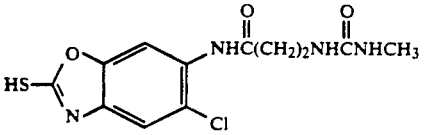
(I-23)
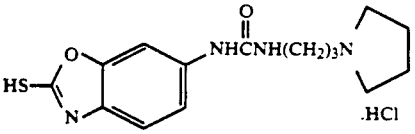
(I-24)
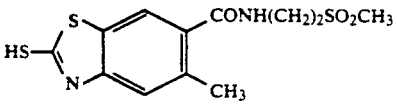
(I-25)
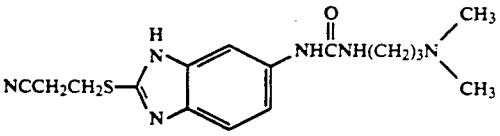
(I-26)
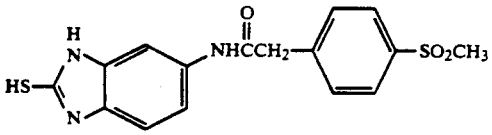
(I-27)
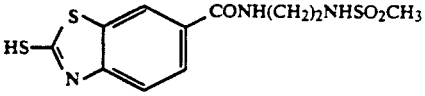
(I-28)
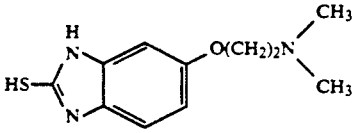
-continued
(I-29)
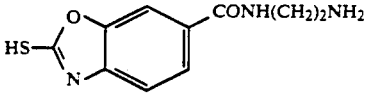
(I-30)
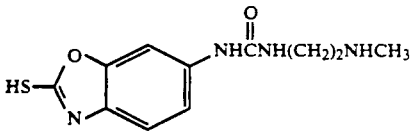
(I-31)
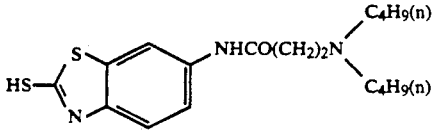
(I-32)
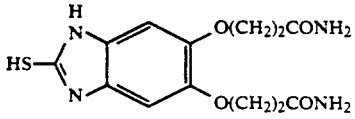
(I-33)
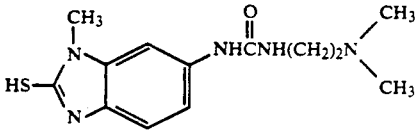
(I-34)
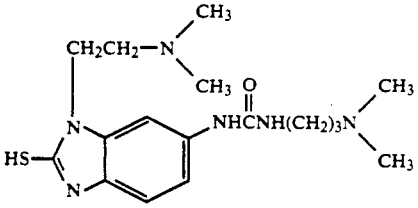
(I-35)
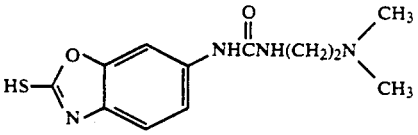
(II-1)
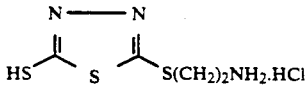
(II-2)
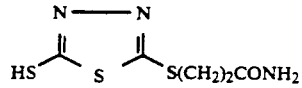
(II-3)
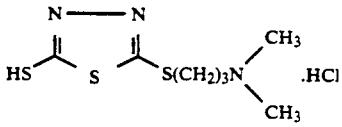
(II-4)
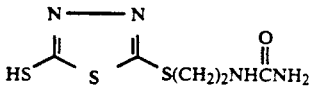
(II-5)
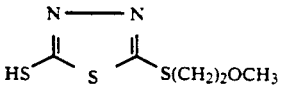

-continued
(II-6)
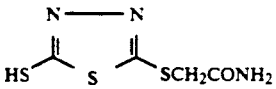
(II-7)
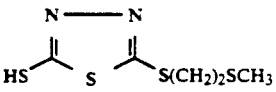
(II-8)
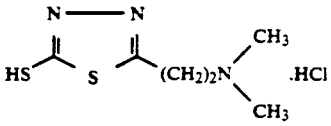
(II-9)
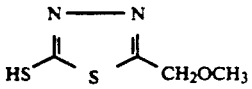
(II-10)
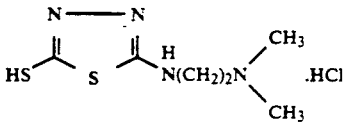
(II-11)
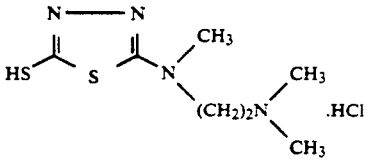
(II-12)
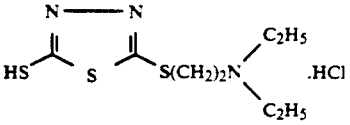
(II-13)
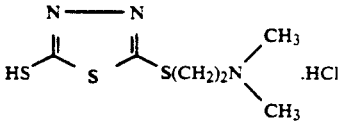
(II-14)
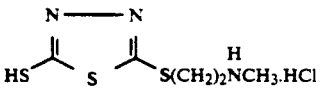
(II-15)
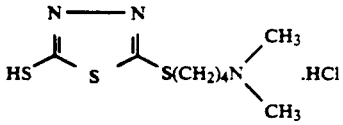
(II-16)
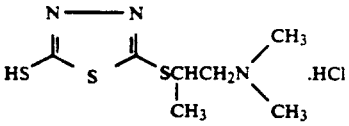
(II-17)
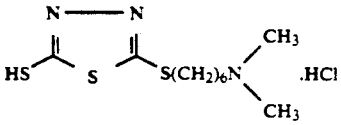
-continued
(II-18)
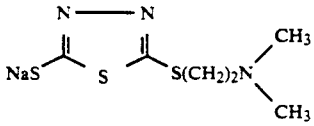
(II-19)
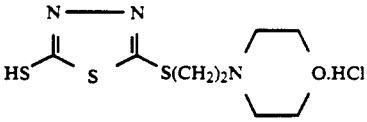
(II-20)
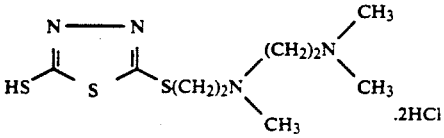
(II-21)
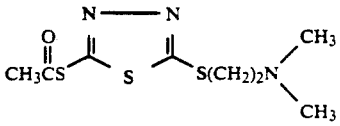
(II-22)
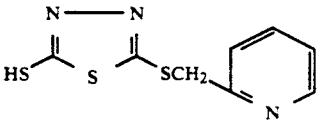
(II-23)
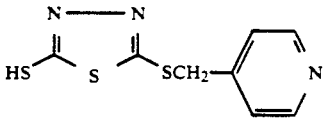
(II-24)
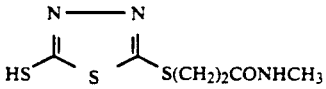
(II-25)
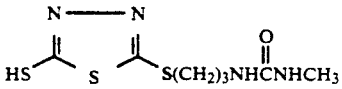
(II-26)
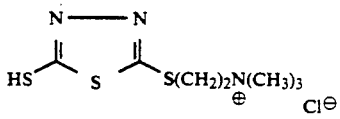
(II-27)
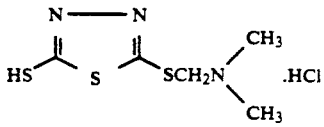
(II-28)
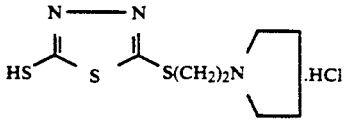
(II-29)
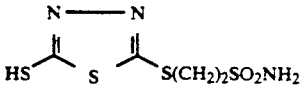
(II-30)
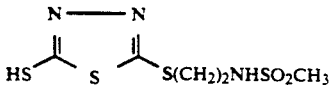

-continued (II-31)

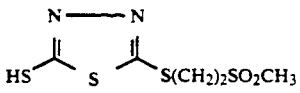

(II-32)

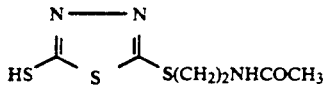

(II-33)

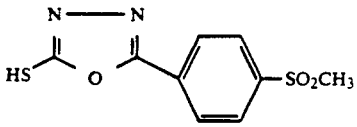

(II-34)

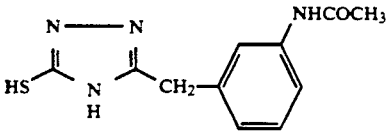

(II-35)

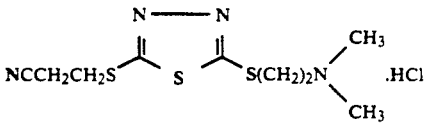

(II-36)

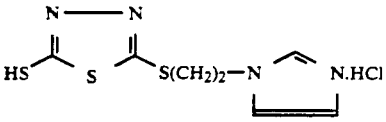

(II-37)

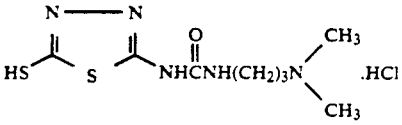

(II-38)

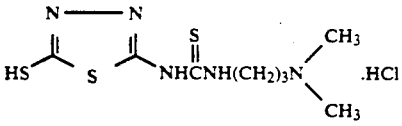

(II-39)

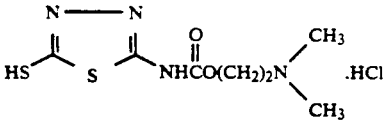

(II-40)

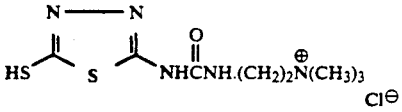

(II-41)

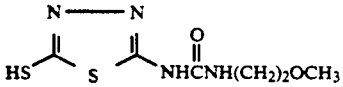

(II-42)

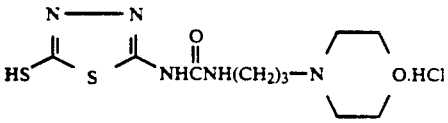

-continued (II-43)

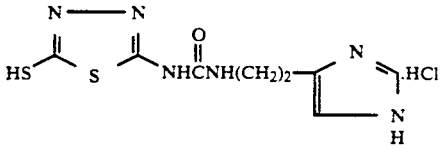

(II-44)

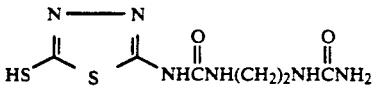

(II-45)

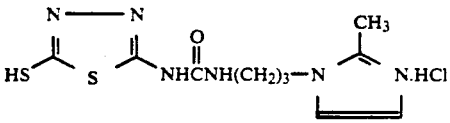

(II-46)

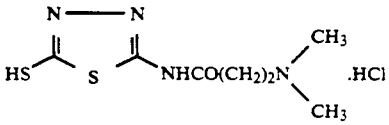

(II-47)

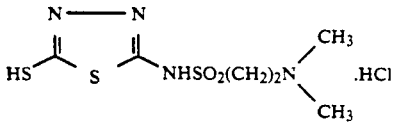

(II-48)

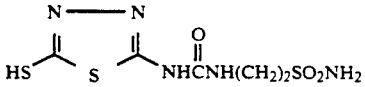

(II-49)

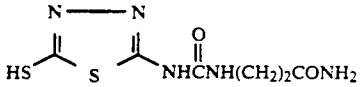

(II-50)

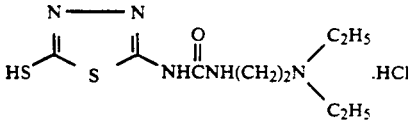

(II-51)

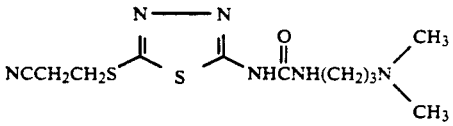

The compounds of this invention represented by the general formula (I) can be synthesized with ease according to the methods described in Organic Synthesis, IV, 569 (1963), Journal of the American Chemical Society, 45, 2390 (1923), Chemische Berichte, 9, 465 (1876), and JP-A-61-99121.

The compounds of this invention represented by the general formula (II) can be synthesized by reference to the methods described in Advances in Heterocyclic Chemistry, volume 9, pages 165 to 209 (1968), Journal of Pharmaceutical Society Japan, volume 71, pages 1481 to 1484 (1951), U.S. Pat. No. 2,823,208, and JP-A-61-156646.

These compounds can be used alone, or as a mixture of two or more thereof.

These compounds may be incorporated in any constituent layer of a heat developable photosensitive material. However, it is desirable that they should be incorporated in a photosensitive layer or an adjacent layer thereto (e.g., an interlayer, a protective layer), especially a photosensitive layer.

They are incorporated in an amount of $10^{-6}$ to 1 mole, preferably $10^{-4}$ mole, per mole of photosensitive silver halide.

In this invention, the above-described compounds can be added to a photographic emulsion in any step of the emulsion-making, or at any stage between the conclusion of the emulsion-making and right before the coating. However, it is generally preferred to add them at any stage between the conclusion of the emulsion-making and right before the coating.

The heat developable photosensitive material of this invention basically has, on a support, a photosensitive silver halide and a binder, and therein can optionally be contained an organic metal salt oxidizing agent, dye-providing compounds (a reducing agent can function as the compound, in such cases as described hereinafter), and so on.

Although these ingredients are incorporated in the same layer in many cases, they may be incorporated into separate layers so long as the layers are situated so as to permit reactions among the ingredients. For instance, the drop in sensitivity can be prevented by incorporating a colored dye-providing compound into a layer disposed under a silver halide emulsion layer. On the other hand, a reducing agent, though preferably incorporated in a heat developable photosensitive element, may be externally supplied to the photosensitive element, e.g., through the diffusion from a dye-fixing element as described hereinafter.

In order to obtain a wide variety of colors in the range of chromaticity diagram using three primary colors of yellow, magenta and cyan, at least three silver halide emulsion layers having their individual sensitivities in different spectral regions are used in combination. For instance, there can be cited a combination of a blue-sensitive, a green-sensitive and a red-sensitive layers, a combination of a green-sensitive, a red-sensitive and an infrared sensitive layers, and so on. These layers can be arranged in various orders known in connection with color photographic materials of general type. Each of these sensitive layers may be divided into two or more layers, if needed.

In the heat developable photosensitive material of this invention, various auxiliary layers such as a protective layer, a subbing layer, an interlayer, a yellow filter layer, an antihalation layer, a backing layer and so on can be provided.

Silver halides which can be used in this invention may include any of silver chloride, silver bromide, silver iodobromide, silver chlorobromide, silver chloroiodide and silver chloroiodobromide.

The silver halide emulsion to be used in this invention may be that of a surface latent image type or that of an internal latent image type. The emulsion of an internal latent image type is used as direct reversal emulsion when combined with a nucleating agent or an optical fogging means. Further, a so called core/shell emulsion in which the interior and the surface of the grains constitute different phases respectively may be used. The silver halide emulsion may be a monodisperse or polydisperse one, and a mixture of different monodisperse emulsions may be used. A preferred grain size of the silver halide used in this invention ranges from 0.1 to 2 μm, particularly from 0.2 to 1.5 μm. A crystal habit of the silver halide grains used in this invention may be any of those of a cube, an octahedron, a tetradecahedron, a tablet having a high aspect ratio, and so on.

Specifically, any of the silver halide emulsions described in U.S. Pat. No. 4,500,626 (column 50), U.S. Pat. No. 4,628,021, RD-17029 (1978), JP-A-62-253159, and so on can be used in this invention.

Those silver halide emulsions, though may be used in the primitive condition, are usually chemically sensitized. In order to effect chemical sensitization, sulfur sensitization, reduction sensitization, noble metal sensitization and other processes known in emulsions for ordinary photosensitive materials can be used independently or in combination. These chemical sensitization processes can be performed in the presence of a nitrogen-containing heterocyclic compound (as disclosed in JP-A-62-253159).

A coverage of the photosensitive silver halide used in this invention ranges from 1 mg/m$^2$ to 10 g/m$^2$ based on the silver.

In this invention, organic metal salts can be used as oxidizing agent together with photosensitive silver halides. Of organic metal salts, organic silver salts are particularly preferred as such an oxidizing agent.

As examples of organic compounds which can be used for forming the above-described organic silver salts to function as oxidizing agent, mention may be made of benzotriazoles described, e.g., in U.S. Pat. No. 4,500,626, columns 52 to 53, fatty acids and so on. In addition, silver salts of carboxylic acid having an alkynyl group, such as silver phenylpropiolate disclosed in JP-A-60-113235, and acetylene silver disclosed in JP-A-61-249044 are also useful. Organic silver salts as described above may be used in combination of two or more thereof.

The organic silver salt can be used in an amount of 0.01 to 10 moles, preferably 0.01 to 1 mole, per mole of the photosensitive silver halide. It is appropriate that a coverage of the photosensitive silver halide and that of the organic silver salt should amount to from 50 mg/m$^2$ to 10 g/m$^2$ in all, based on the silver.

Conventional antifoggants or photographic stabilizers can also be used together in this invention. Suitable examples of such agents, mention may be made of the azoles and the azaindenes described in RD-17643, pages 24 to 25 (1978), the nitrogen-containing carboxylic acids and phosphoric acids disclosed in JP-A-59-168443, the mercapto compounds and the metal salts thereof disclosed in JP-A-59-111636, the acetylene compounds disclosed in JP-A-62-87957, and so on.

The silver halides to be used in this invention may be spectrally sensitized with methine dyes or the like. Dyes usable for spectral sensitization include cyanine dyes, merocyanine dyes, complex cyanine dyes, complex merocyanine dyes, holopolar cyanine dyes, hemicyanine dyes, styryl dyes and hemioxonol dyes.

Specific examples of the above-cited dyes are disclosed in U.S. Pat. No. 4,617,257, JP-A-59-180550, JP-A-60-140335, RD-17092, pages 12 to 13 (1978), and so on.

Those sensitizing dyes may be used alone or in combination. Combinations of sensitizing dyes are often used in particular for the purpose of supersensitization.

Materials which can exhibit a supersensitizing effect in combination with a certain sensitizing dye although they themselves do not spectrally sensitize silver halide emulsions or do not substantially absorb light in the visible region may be incorporated into the silver halide emulsion (as disclosed in U.S. Pat. No. 3,615,641, Japanese Patent Application No. 61-226294 (corresponding to JP-A-63-23145), and so on).

Such sensitizing dyes may be added to emulsions during, before or after the chemical ripening step, or may be added thereto before or after the nucleation of silver halide grains according to U.S. Pat. Nos. 4,183,756 and 4,225,666. The amount added generally ranges from about $10^{-8}$ to $10^{-2}$ mole per mole of the silver halide.

Binders which can be preferably used in constituent layers of the photosensitive material and the dye fixing material are hydrophilic ones. As examples of hydrophilic binders, mention may be made of those described in JP-A-62-253159, pages 26 to 28. More specifically, transparent or translucent hydrophilic binders, e.g., natural compounds such as proteins including gelation and gelatin derivatives, cellulose derivatives, and polysaccharides including starch, gum arabic, dextran, pullulan and the like; and synthetic high molecular compounds such as polyvinyl alcohol, polyvinyl pyrrolidone, acrylamide polymers and so on, can be preferably used. In addition, highly water-absorbing polymers disclosed in JP-A-62-245260, that is, a homopolymer of a vinyl monomer containing —COOM or —$SO_3M$ (where M represents a hydrogen atom or an alkali metal), copolymers prepared from vinyl monomers of the above-described kind alone, or copolymers prepared from the above-described vinyl monomer(s) and other vinyl monomers (e.g., sodium methacrylate, ammonium methacrylate, Sumika Gel L-5H, produced by Sumitomo Chemical Co., Ltd.) can be used. These binders can be used as a combination of two or more thereof.

When a system in which heat development is carried out in the presence of a slight amount of water supplied externally is employed, the used of the above-described highly water-absorbing polymers enables the rapid absorption of water. Further, the use of the highly water-absorbing polymers in a dye fixing layer or the protective layer thereof can prevent the dyes transferred into the dye fixing material from retransferring into others.

A coverage of the binder used in this invention is properly controlled to not more than 20 g/$m^2$, preferably not more than 10 g/$m^2$, and particularly preferably not more than 7 g/$m^2$.

Constituent layers of the photosensitive material and the dye fixing material (including a backing layer) can contain various kinds of polymer latexes for the purpose of enhancing physical properties as film, such as dimensional stability, anticurling, adhesion resistance, cracking resistance and prevention of pressure sensitization or desensitization. Specifically, any of the polymer latexes disclosed in JP-A-62-245258, JP-A-62-136648, JP A-62-110066, and so on can be used. In particular, polymer latexes having a low glass transition point (below 40° C.) can prevent the generation of cracking when used in the mordanting layer, and those having a high glass transition point can produce an anticurl effect when used in the backing layer.

Reducing agents which can be used in this invention include those known in the field of heat developable photosensitive materials. Also, dye-providing compounds having reducing power described hereinafter are included therein. (When the dye-providing compounds of such as kind are employed, other reducing agents can also be used together.) In addition, precursors of reducing agents, which themselves do not have any reducing powder, but acquire it through the interaction with a nucleophilic agent or heat in the course of development, can be used.

Examples of reducing agents and precursors thereof which can be used in this invention include those disclosed in U.S. Pat. No. 4,500,626, columns 49 to 50, U.S. Pat. No. 4,483,914, columns 30 to 31, U.S. Pat. No. 4,330,617, U.S. Pat. No. 4,590,152, JP-A-60-140335, pp. 17 to 18, JP-A-57-40245, JP-A-56-138736, JP-A-59-178458, JP-A-59-53831, JP-A-59-182449, JP-A 59-182450, JP-A-60-119555, JP-A 60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, JP-A-62-131256, EP-A-220746, pp. 78 to 96, and so on.

Various combinations of reducing agents as disclosed in U.S. Pat. No. 3,039,869 can be used, too.

When a nondiffusible reducing agent is used, an electron transmitter and/or a precursor thereof can optionally be used in combination therewith in order to accelerate the transfer of an electron between the nondiffusible reducing agent and a developable silver halide.

Such an electron transmitter or a precursor thereof can be chosen from the above-described reducing agents and precursors thereof. It is desirable that the electron transmitter or the precursor thereof should have mobility greater than that of the nondiffusible reducing agent (electron donator) to be used together. Particularly useful electron transmitters are 1-phenyl-3-pyrazolidones or aminophenoles.

A nondiffusible reducing agent (electron donator) to be used in combination with such an electron transmitter described above may be any of the above-described reducing agents so long as it does not move, in a substantial sense, from one constituent layer to another in the photosensitive material. As suitable examples thereof, mention may be made of hydroquinones, sulfonamidophenols, sulfonamidonaphthols, the compounds disclosed as electron donators in JP-A-53-110827, nondiffusible dye-providing compounds having a reducing powder as described hereafter, and so on.

A preferred amount of a reducing agent used in this invention ranges from 0.01 to 20 moles, particularly from 0.1 to 10 moles, per 1 mole of the silver.

In this invention, silver can be used as an image forming substance, and compounds capable of producing or releasing mobile dyes in correspondence or counter-correspondence to the reduction of silver ion to silver under a high temperature condition, that is to say, dye-providing compounds can also be contained together with the silver.

First of all, compounds capable of forming dyes by the oxidative coupling reaction (couplers) can be cited as instances of dye-providing compounds usable in this invention. These couplers may be four-equivalent or two-equivalent ones. Also, two-equivalent couplers containing a nondiffusible group as their individual splitting-off groups and producing a diffusible dye by the oxidative coupling reaction can be preferably used. Such a nondiffusible group may assume the form of polymer chain. Specific examples of color developing agents and couplers are described in detail in T. H. James, *The Theory of the Photographic Process*, 4th Ed., pages 291 to 334 and 354 to 361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, and so on.

As other examples of dye-providing compounds, mention may be made of compounds which have such a function as to release or diffuse imagewise a diffusible dye. The compounds of this type can be represented by the following general formula (LI):

$$(Dye—Y)_n—Z \quad (LI)$$

wherein Dye represents a dye moiety, a dye moiety whose absorption band is temporarily shifted to shorter wave lengths, or a precursor of a dye moiety; Y represents a mere bonding hand, or a linkage group; Z represents such a group as to cause an imagewise change in diffusibility of the compound of the formula $(Dye—Y)_n—Z$, or to release imagewise the moiety Dye to bring about a difference in diffusibility between the released Dye and $(Dye—Y)_n—Z$ in correspondence or counter-correspondence with the photosensitive silver salt imagewise bearing with an latent image; and n represents 1 or 2, and when n is 2, two (Dye—Y)'s may be the same or different.

As specific examples of dye-providing compounds represented by the general formula (LI), mention may be made of those classified into the following groups from (1) to (5). Making additional remarks, the compounds classified into the groups from (1) to (3) are those of the kind which form diffusible dye images in counter-correspondence with the development of silver halide (positive dye images), while the compounds classified into the groups (4) and (5) are those of the kind which form diffusible dye images in correspondence with the development of silver halide (negative dye images).

The group (1) consists of dye developing agents in which a hydroquinone type developing agent and a dye component are connected to each other, with specific examples including those disclosed in U.S. Pat. Nos. 3,134,764, 3,362,819, 3,597,200, 3,544,545 and 3,482,972, and so on. Such dye developing agents are diffusible under an alkaline condition, but rendered nondiffusible by the reaction with silver halide.

The group (2) consists of nondiffusible compounds of the kind which can release a diffusible dye under an alkaline condition, but lose that ability upon the reaction with silver halide, as disclosed in U.S. Pat. No. 4,503,137. Specific examples of each compounds as described above include the compounds capable of releasing a diffusible dye by the intramolecular nucleophilic substitution reaction as disclosed in U.S. Pat. No. 3,980,479 and so on, and the compounds capable of releasing a diffusible dye by the intramolecular rearrangement reaction of an isooxazolone ring as disclosed in U.S. Pat. No. 4,199,354, and so on.

The group (3) consists of nondiffusible compounds of the kind which can release a diffusible dye by the reaction with a reducing agent which has remained unoxidized through development, as disclosed in U.S. Pat. No. 4,559,290, EP A-220746, Kokai Giho 87-6199, and so on. Specific examples of such compounds include those disclosed in U.S. Pat. Nos. 4,139,389 and 4,139,379, JP-A-59-185333, JP-A-57-84453 and so on, which can release a diffusible dye by the intramolecular nucleophilic substitution reaction after they are reduced; those disclosed in U.S. Pat. No. 4,232,107, JP-A-59-101649, JP-A-61-88257, RD-24025 (1984) and so on, which can release a diffusible dye by the intramolecular electron transfer reaction after they are reduced; those disclosed in West German Patent 3,008,588A, JP-A-56-142530, U.S. Pat. No. 4,343,893, U.S. Pat. No. 4,619,884, and so on, which can release a diffusible dye by the single-bond cleavage after the reduction; the nitro compounds disclosed in U.S. Pat. No. 4,450,223, and so on, which can release a diffusible dye after the electron acceptance; the compounds disclosed in U.S. Pat. No. 4,609,610 and so on, which can release a diffusible dye after the electron acceptance; and so on.

More preferred examples of compounds belonging to this group include those having both a N—X bond (where X represents an oxygen, sulfur or nitrogen atom) and an electron attractive group in a molecule, as disclosed in EP-A-220746, Kokai Giho 87-6199, JP-A-62-34953 and 62-34594 (corresponding to JP-A-63-201653 and JP-A-63-201654, respectively), and so on; those having both a $SO_2$—X bond (where X has the same meaning as described above) and an electron attractive group in a molecule, as disclosed in JP-A-62-106885 (corresponding to JP-A-1-26842); those having both a PO—X bond (where X has the same meaning as described above) and an electron attractive group in a molecule, as disclosed in JP-A-62-106895 (corresponding to JP-A-63-271344); and those having both a C—X' bond (where X' has the same meaning as X, or represents —$SO_2$—) and an electron attractive group in a molecule, as disclosed in JP-A-132 Application 62-106887 (corresponding to JP-A-63-271341).

Among these compounds, those having both a N—X bond and an electron attractive group in a molecule are preferred in particular. Specific examples of such compounds include those cited in EP-A-220746 as the compound examples (1) to (3), (7) to (10), (12), (13), (15), (23) to (26), (31), (32), (35), (36), (40), (41), (44), (53) to (59), (64) and (70), and those cited in Kokai Giho 87-6199 as the compound examples (11) to (23).

The group (4) consists of couplers of the kind which have a diffusible dye residue as a splitting-off group and release the diffusible dye by the reaction with the oxidation product of a reducing agent (DDR couplers). Specific examples of such couplers include those disclosed in British Patent 1,330,524, JP-B-48-39165 (the term "JP-B" as used herein means an "examined Japanese patent publication"), U.S. Pat. Nos. 3,443,940, 4,474,867 and 4,483,914, and so on.

The group (5) consists of compounds of the kind which can reduce silver halides or organic silver salts, and release a diffusible dye upon the reduction of these silver salts (DRR compounds). Since these compounds do not require the combined use with other reducing agents, they have an advantage in that they can produce images free from stains arising from the oxidative decomposition products of reducing agents. Representatives of these DRR compounds are disclosed in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Pat. Nos. 3,725,062, 3,728,113 and 3,443,939, JP-A-58-116,537, JP-A-57-179840, U.S. Pat. No. 4,500,626, and so on. As specific examples of DRR compounds which can be preferably used in this invention, mention may be made of the compounds illustrated on the columns from 22nd to 44th of the above-cited U.S. Pat. No. 4,500,626, particularly those illustrated as the compound examples (1) to (3), (10) to (13), (16) to (19), (28) to (30), (33) to (35), (38) to (40), and (42) to (64). In addition, the compounds disclosed on the columns from 37th to 39th of the above-cited U.S. Pat. No. 4,639,408 are useful, too.

As dye-providing compounds other than the above-described couplers and the compounds represented by the general formula (LI), dye silver compounds in which an organic silver salt and a dye are bound to each other (as described in *Research Disclosure*, Vol. 169, pages 54 to 58 (May 1978)), azo dyes which can be used in heat developable silver dye bleach process (as disclosed in U.S. Pat. No. 4,235,957, Research Disclosure, Vol. 144, pages 30 to 32 (Apr. 1976)), leuco dyes (as disclosed in U.S. Pat. Nos. 3,985,565 and 4,022,617), and so on can be employed in this invention.

Hydrophobic additives including dye-providing compounds, nondiffusible reducing agents and so on can be introduced into constituent layers of the photosensitive material according to known methods described, e.g., in U.S. Pat. No. 2,322,027. Therein, high boiling organic solvents as disclosed in JP-A-59-83154, JP-A-59-178451, JP-A-59-178452, JP-A-59-178453, JP-A-59-178454, JP-A-59-178455, JP-A-59-178457 and so on can be used, if necessary, together with low boiling organic solvents having a boiling point ranging from 50° C. to 160° C.

An amount of the high boiling organic solvent used is controlled to 10 g or less, preferably 5 g or less, per 1 g or the dye-providing compounds. As for the amount of the high boiling organic solvent used per 1 g of the binder, it is appropriately 1 ml or less, preferably 0.5 ml of less, and particularly preferably 0.3 ml or less.

Introduction of hydrophobic additives into the photosensitive material can be affected in accordance with a dispersion method utilizing polymers as disclosed in JP-B-51-39853 and JP-A-51-59943.

In addition to the above-described methods, compounds which are insoluble in water in a substantial sense can be introduced by dispersing fine grains of them into a binder.

In dispersing hydrophobic compounds into a hydrophilic colloid, various kinds of surfactants can be used. For instance, those exemplified as surfactant on the pages 37 and 38 of JP-A-59-157636 can be employed therein.

Compounds which can promote the activation of development and the stabilization of image at the same time can be used in this invention. Specific examples of such compounds which can be preferably used are described on the columns 51 and 52 of U.S. Pat. No. 4,500,626.

In the system of forming images by the diffusion transfer of dyes, a dye-fixing material is used in combination with the photosensitive material. The dye-fixing material and the photosensitive material may be provided independently on separate supports, or may be provided in layers on the same support. As for the correlation of the dye-fixing material with the photosensitive material, and as for the relations of the dye-fixing material to a support and to a white reflective layer, those described on the column 57 of U.S. Pat. No. 4,500,626, can be applied to this invention.

A dye fixing material which is preferably used in this invention has at least one layer containing a mordant and a binder. Therein, mordants known in the photographic art can be used, and specific examples thereof include those described on the columns 58 and 59 of U.S. Pat. No. 4,500,626, on the pages from 32 to 41 of JP-A-61-88256, and particularly preferably include those disclosed in JP-A-62-244043 and JP-A-62-244036. In addition, dye-accepting high molecular compounds as disclosed in U.S. Pat. No. 4,463,079 may be used as the mordant.

The dye-fixing material can be provided with auxiliary layers, such as a protective layer, a peeling-apart layer, an anticurl layer and so on, if desired. In particular, it is useful to provide a protective layer.

In constituent layers of the photosensitive material and the dye-fixing material, a plasticizer, a slipping agent or a high boiling organic solvent for enhancing a facility in peeling apart the dye-fixing material from the photosensitive material can be contained. Specific examples thereof include those disclosed in JP-A-62-253159 (page 25), JP-A-62-245253 and so on.

For the above-described purpose, various silicone oils (covering from dimethylsilicone oil to modified silicone oils prepared by introducing various kinds of organic groups into dimethylsiloxane) can be further used. As examples of effective silicone oils, mention may be made of a wide variety of modified silicone oils described in "Hensei Silicone Oil" Gijutsu Shiryo P6-18B (which means technical data on modified silicone oils), published by Shin-etsu Silicone Co., Ltd. In particular, carboxy-modified silicone (trade name; X-22-3710) is used to advantage.

In addition, silicone oils disclosed in JP-A-62-215953 and JP-A-62-23687 (corresponding to JP-A-63-46449) are effective, too.

The photosensitive materials and the dye-fixing material may contain a discoloration inhibitor. Suitable discoloration inhibitors include, e.g., antioxidants, ultraviolet absorbents and certain metal complexes.

Suitable antioxidants include, e.g., chroman compounds, coumaran compounds, phenol compounds (e.g., hindered phenols), hydroquinone derivatives, hindered amine compounds, and spiroindane compounds. Also, the compounds disclosed in JP-A-61-159644 are effective as antioxidants.

Suitable ultraviolet absorbents include benzotriazole compounds (as disclosed in U.S. Pat. No. 3,533,794), 4-thiazolidone compounds (as disclosed in U.S. Pat. No. 3,352,681), benzophenone compounds (as disclosed in JP-A-46-2784), and other compounds as disclosed in JP-A-54-48535, JP-A-62-136641 and JP-A-61-88256. In addition, the ultraviolet absorbing polymers disclosed in JP-A-62-260152 are also effective.

Suitable metal complexes include the compounds disclosed, e.g., in U.S. Pat. Nos. 4,241,155, 4,245,018 (columns 3 to 36) and 4,254,195 (columns 3 to 8), JP-A-62-174741, JP-A-61-88256 (pages 27 to 29), JP-A-62-234103 and 62-31096 (corresponding to JP-A-1-75568 and JP-A-63-199248), and so on.

Examples of useful discoloration inhibitors are described in JP-A-62-215272 (pages 125 to 137).

Discoloration inhibitors for preventing the dyes transferred in the dye-fixing material from undergoing discoloration may be incorporated in advance in the dye-fixing material, or supplied externally (e.g. from the photosensitive material) to the dye-fixing material.

The above-described antioxidants, ultraviolet absorbents and metal complexes may be used in combination.

In the photosensitive material and the dye-fixing material, a brightening agent may be used. In particular, it is desirable that a brightening agent should be incorporated in the dye-fixing material or supplied externally (e.g., from the photosensitive material) thereto. As examples of a brightening agent which can be used, mention may be made of the compounds as described in K. Veenkataraman (editor), *The Chemistry of Synthetic*

*Dyes*, volume V, chapter 8, JP-A-61-143752, and so on. More specifically, stilbene compounds, coumarin compounds, biphenyl compounds, benzoxazolyl compounds, naphthalimide compounds, pyrazoline compounds, carbostyryl compounds and the like can be effectively used as the brightening agent.

These brightening agents can be used in combination with discoloration inhibitors.

Hardeners suitable for the use in constituent layers of the photosensitive material and the dye-fixing material are those disclosed in U.S. Pat. No. 4,678,739 (column 41), JP-A-59-116655, JP-A-62-245261, JP-A-61-18942, and so on. More specifically, there can be cited aldehyde type hardeners (e.g., formaldehyde), aziridine type hardeners, epoxy type hardeners (e.g.,

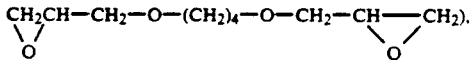

vinylsulfon type hardeners (e.g., N,N'-ethylene-bis(-vinylsulfonylacetamido)ethane), N-methylol type hardeners (e.g., dimethylol urea), and high molecular hardeners (e.g., the compounds disclosed in JP-A-62-234157).

For various purposes, e.g., as a coating aid, for the enhancement of peeling facility and slippability, for the prevention of electrification, for the acceleration of development, and so on, various surfactants can be used in constituent layers of the photosensitive materials and the dye-fixing material. Specific examples of surfactants suitable for the above-described purposes include those disclosed in JP-A-62-73463, JP-A-62-183457, and so on.

For the purposes of improvements in slippability, antistatic property, peeling facility and so on, organic fluorinated compounds may be incorporated in constituent layers of the photosensitive material and the dye-fixing material. As typical representatives of such organic fluorinated compounds, there can be cited fluorine-containing surfactants disclosed in JP-B-57-9053 (columns 8 to 17), JP-A-61-20944, JP-A-62-135826 and so on, and hydrophobic fluorine compounds including oily fluorine compounds, such as fluorine-containing oil, and solid fluorine-containing resins, such as tetrafluorinated ethylene resin.

A matting agent can be used in the photosensitive material and the dye-fixing material. As examples of a matting agent which can be used, mention may be made of silicon dioxide, the compounds described in JP-A-61-88256 (page 29), such as polyolefins, polymethylmethacrylate and the like, and the substances disclosed in JP-A-62-110064 and 62-110065 (corresponding to JP-A-63-274944 and JP-A-63-274952, respectively), such as benzoguanamine resin beads, polycarbonate resin beads, AS resin beads and the like.

In addition to the above-cited additives, thermal solvents, defoaming agents, antibacteria and antimolds, colloidal silica and so on may be incorporated in constituent layers of the photosensitive material and the dye-fixing material. Specific examples of these additives are described, e.g., in JP-A-61-88256 (pages 26 to 32).

In the photosensitive material and/or the dye-fixing material of this invention, image formation accelerators can be used. The image-formation accelerators have such functions that they can accelerate the redox reaction between a silver salt oxidizing agent and a reducing agent, the production of dyes, the decomposition of dyes or the release of diffusible dyes from dye-providing substances, and the transfer of the dyes from the photosensitive material to the dye-fixing material. From the standpoint of physicochemical functions, the image-formation accelerators are classified into groups, such as bases, base precursors, nucleophilic compounds, high boiling organic solvents (oils), thermal solvents, surfactants, compounds having an interaction with silver or silver ion, and so on. In general, substances belonging to these groups have combined functions, and each substance usually has some of the above-cited acceleration effects. Details of these accelerators and their functions are described in U.S. Pat. No. 4,678,739 (pages 38 to 40).

As examples of base precursors, there can be given the salts prepared from bases and organic acids to be decarboxylated by heating, and compounds capable of releasing amines by undergoing the intramolecular nucleophilic substitution reaction, Lossen rearrangement or Beckmann rearrangement. More specifically, such compounds are described in U.S. Pat. No. 4,511,493, JP-A-62-65038, and so on.

In a system of the type which performs heat development and the dye transfer at the same time in the presence of a small amount of water, it is to be desired for the enhancement of keeping quality of the photosensitive material that a base and/or a precursor thereof should be incorporated in the dye fixing material.

In addition to the above-cited compounds, combinations of slightly soluble metal compounds and compounds capable of undergoing the complexation reaction (called complexing compounds) with metal ions constituting these metal compounds, as disclosed in EP-A-210660, and compounds capable of producing bases through electrolysis, as disclosed in JP-A-61-232451 can be used as base precursors. In particular, the former combination is effective, and it is more advantageous that a slightly soluble metal compound and a complexing compound are incorporated separately in the photosensitive material and the dye-fixing material.

Various development stoppers can be used in the photosensitive material and/or the dye-fixing material of this invention for the purpose of stationarily producing images of the same quality in spite of fluctuations in processing temperature and processing time during the development.

The term development stopper as used herein describes a compound of the kind which can stop the development by rapidly neutralizing a base or reacting with a base after the proper development to lower the base concentration in the film, or can retard the development through the interaction with silver or a silver salt. Specific examples thereof include acid precursors capable of releasing acids by heating, electrophilic compounds capable of causing a substitution reaction with a base present together by heating, nitrogen-containing heterocyclic compounds, mercapto compounds and precursors thereof, and so on. Details of these compounds are described in JP-A-62-253159 (pages 31 to 32).

As a support of the photosensitive material and the dye-fixing material of this invention, materials which can withstand processing temperatures to be employed are used. In general, paper and synthetic polymers (films) can be cited as instances. Specific examples of usable supports include films of polyethylene terephthalate, polycarbonate, polyvinyl chloride, polystyrene, polypropylene, polyimide and celluloses (e.g., triacetyl cellulose), those prepared by dispersing a pigment, such as titanium oxide, into such films as cited above, film process synthetic paper made from polypropylene or the like, paper made from a mixture of synthetic resin pulp, such as polyethylene pulp, and natural pulp, Yankee paper, baryta paper, coated paper (especially cast-coated paper), metals, cloths, glasses, and so on.

These materials may be used individually as they are, or some of them are used in a condition that they are laminated with a synthetic polymer, such as polyethylene or the like, on one side or both sides thereof.

In addition to the above-cited supports, those described in JP-A-62-253159 (pages 29 to 31) can be employed.

On the surface of a support as described above, a hydrophilic binder, alumina sol, a semiconductive metal oxide such as tin oxide, and an antistatic agent such as carbon black may be coated.

In exposing the photosensitive material to light with imagewise patterns to record it therein, there can be adopted various exposing methods, e.g., a method of directly taking photographs of sceneries and figures with a camera or the like, a method of exposing the photosensitive material to light through a reversal film or a negative film using a printer, an enlarger or the like, a method of scanning rays of light passing through a slit over an original with an exposure apparatus installed in a copying machine or the like, a method of forcing a light emission diode or a wide variety of laser devices to emit light by sending thereto electric signals bearing with image information, and irradiating the photosensitive material with the emitted light, a method of putting out image information on an image display unit such as a CRT, a liquid crystal display, an electroluminescence display or a plasma display screen, and exposing the photosensitive material to the displayed image directly or through an optical system, and so on.

Light sources suitable for recording images in the photosensitive material include natural light, a tungsten lamp, light emission diodes, laser light sources, CRT light sources and so on, as described in U.S. Pat. 4,500,626 (column 56).

Also, imagewise exposure can be performed by using a wavelength changing element made by combining a nonlinear optical material and a coherent light source such as laser beams. The term nonlinear optical material as used herein refers to the material of the kind which can create a nonlinearity relationship between the electric field and the polarization to emerge upon application of a strong photoelectric field such as laser beams. Compounds preferred as such an nonlinear optical material as defined above include inorganic compounds represented by lithium niobate, potassium dihydrogen phosphate (KDP), lithium iodate, $BaB_2O_4$ and the like, urea derivatives, nitroaniline derivatives, nitropyridine-N-oxide derivatives such as 3-methyl-4-nitropyridine-N-oxide (POM), and the compounds disclosed in JP-A-61-53462 and JP-A-62-210432. As for the form of the wavelength changing element, that of a single-crystal light-waveguide lane, that of a fiber and so on are known, and each is useful in this invention.

As for the image information, those obtained from video cameras, electronic still cameras or the like, television signals of NTSC color system (NTSC: National Television System Committee), image signals obtained by dividing an original into a great number of image elements using a scanner or the like, and image signals produced by the use of a computer which are represented by CG and CAD can be utilized.

The photosensitive material and/or the dye-fixing material may be provided with a conductive heat-emission layer to function as heating means for heat development or diffusion transfer of dyes. Therein, transparent or opaque heat-emission elements described, e.g., in JP-A-61-145544 can be utilized. Making an additional remark, such as conductive layer as described above can function as an antistatic layer, too.

It is possible to effect the heat development by heating at temperatures of about 50° C. to about 250° C. In particular, heating temperatures ranging from about 80° C. to about 180° C. are useful. The dye diffusion transfer step may be carried out at the same time as the heat development step, or after the conclusion of the heat development step. In the latter case, it is possible to achieve the transfer as far as heating temperature adopted in the transfer step is in the range of the temperature adopted in the heat development step to room temperature. However, the transfer can be accomplished more efficiently under a heating temperature ranging from 50° C. to the temperature lower than that adopted in the heat development step by about 10° C.

The transfer of dyes, though can be caused by heat alone, may be carried out with the aid of a solvent of the kind which can promote the dye transfer.

In addition, as described in detail in JP-A-59-218443, JP-A-61-238056 and so on, a method of heating in the presence of a small amount of solvent (especially water) to achieve the development and the transfer simultaneously or successively can be used to advantage. In this method, a preferred heating temperature is in the range of 50° C. to a boiling point of the solvent used. For instance, temperatures from 50° C. to 100° C. are desirable when water is used as the solvent.

As examples of solvents which can be used for the acceleration of development and/or the transfer of diffusible dyes into the dye-fixing layer, mention may be made of water and basic aqueous solutions containing inorganic alkali metal salts or organic bases. (As for the bases, those given as examples of image-formation accelerators hereinbefore can be used.) Also, a low boiling solvent, or a mixture of a low boiling solvent with water or a basic aqueous solution can be used for the above-described purpose(s). Further, surfactants, antifoggants, slightly soluble metal salts and complexing compounds may be contained in solvents as described above.

These solvents each can be used in such a manner that it may be given to either the dye fixing material or the photosensitive material, or both of them. Each solvent can serve its purpose when used in such a small amount as to be below the weight of the solvent having a volume equivalent to the maximal swelling volume of the whole layers coated (especially below the weight obtained by deducting the weight of the whole layers coated from the weight of the solvent having a volume equivalent to the maximal swelling volume of the whole layers coated).

The solvent can be given to the photosensitive material or the dye-fixing material in accordance with, e.g., the method described in JP-A-61-147244 (page 26). Also, it can be used in such a condition as to be incorporated in advance in the photosensitive material or the dye-fixing material in the microencapsulated from or the like.

In order to promote the dye transfer, there can be adopted a method of incorporating a hydrophilic thermal solvent, which melts at high temperatures though it is a solid at ordinary temperatures, into the photosensitive material or the dye-fixing material. The hydrophilic thermal solvent may be incorporated into either the photosensitive material or the dye-fixing material, or both of them. It may be incorporated in any of the constituent layers including emulsion layers, interlayers, protective layers and dye fixing layers. However, it is desirable that the hydrophilic thermal solvent should be incorporated into a dye-fixing layer and/or the layers adjacent thereto.

Suitable examples of hydrophilic thermal solvents include ureas, pyrimidines, amides, sulfonamides, imides, alcohols, oximes and other heterocyclic compounds.

Further, a high boiling solvent may be incorporated in the photosensitive material and/or the dye-fixing material in order to promote the dye transfer.

The heating in the development and/or the transfer step can be affected, e.g., by the direct contact with heated block and plate, or the contact with a hot plate, a hot presser, a hot roller, a halogen lamp heater or an infrared and far infrared lamp heater, or the passage through high temperature atmosphere.

In bringing the photosensitive material and the dye-fixing material into a face-to-face close contact with each other, the pressure application conditions and the pressure-applying means described in JP-A-61-147244 (page 27) can be properly adopted.

For photographic processing of the photographic elements of this invention, any of conventional heat developing apparatuses can be employed. For instance, apparatuses as disclosed in JP-A-59-75247, JP-A-59-177547, JP-A-59-181353, JP-A-60-18951, JP-A-U-62-25944 (the term "JP-A-U" as used herein means an "unexamined published Japanese utility model application"), and so on can be preferably used.

This invention will now be illustrated in more detail by reference to the following examples, but this invention should not be construed as being limited thereto. The percentages hereafter are by weight unless otherwise indicated.

EXAMPLE 1

(1) Preparation of Silver Halide Emulsions

Emulsion (1):

The solution (I), the solution (II) and the solution (III) described below were simultaneously added over a 30-minute period at the same and constant flow rate to an aqueous gelatin solution (containing 20 g of gelatin, 1 g of potassium bromide and 0.5 g of $HO(CH_2)_2S(CH_2)_2OH$ in 800 ml of water, and kept at 50° C.) with thoroughly stirring. Thus, a dye-adsorbed monodisperse pebble-like silver bromide emulsion having an average grain size of 0.42 μm was prepared.

After washing with water and desalting, 20 g of lime-processed ossein gelatin was further added to the emulsion. Then, the pH and the pAg of the resulting emulsion were adjusted to 6.4 by NaOH and 8.2 by KBr, respectively. Thereafter, the temperature of the emulsion was maintained at 60° C., and thereto were added 9 mg of sodium thiosulfate, 6 ml of a 0.01% aqueous solution of chloroauric acid and 190 mg of 4-hydroxy-6-methyl-1,3,3a,7-tetrazaindene. The resulting emulsion was allowed to stand for 45 minutes at that temperature to affect chemical sensitization. A yield of the emulsion was 635 g.

| | Solution I (450 ml in toto by addn. of water) | Solution II (400 ml in toto by addn. of water) | Solution III (60 ml in toto by addn. of methanol) |
|---|---|---|---|
| $AgNO_3$ | 100 g | — | — |
| KBr | — | 70 g | — |
| Dye (a) | — | — | 40 mg |
| Dye (b) | — | — | 80 mg |

Dye (a)

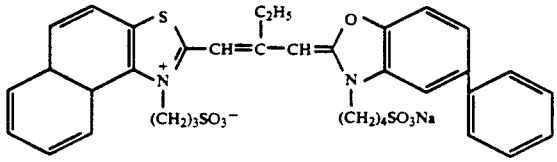

Dye (b)

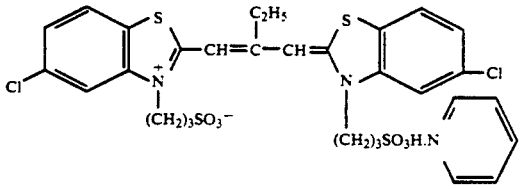

Emulsion (II):

The solution (I) and the solution (II) described below were simultaneously added over a 60-minute period at the same and constant flow rate to an aqueous solution (containing 20 mg of gelatin, 0.30 g of potassium bromide, 6 g of sodium chloride and 0.015 g of the agent A illustrated below in 730 ml of water, and kept at 60.0° C.) with thoroughly stirring. After the conclusion of the addition of the solution (I), the solution (III) (containing the sensitizing dye illustrated below in methanol) was further added. Thus, a dye-adsorbed monodisperse cubic silver chlorobromide emulsion having an average grain size of 0.45 μm was prepared.

After washing with water and desalting, 20 g of gelatin was further added to the emulsion. Then, the resulting emulsion were adjusted to pH 6.4 by NaOH and pAg 7.8 by NaCl, and subjected to chemical sensitization at 60.0° C. The agents used for chemical sensitization were 1.6 mg of triethyl thiourea and 100 mg of 4-hydroxy-6-methyl-1,3,3a,7-tetrazaindene, and the ripening time was 55 minutes. A yield of the emulsion was 635 g.

Agent A

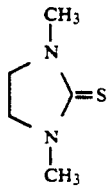

-continued

Sensitizing Dye (c)

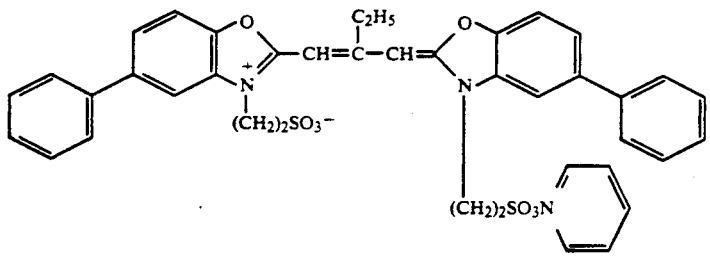

| | Solution I (400 ml in toto by addn. of water) | Solution II (400 ml in toto by addn. of water) | Solution III (77 ml in toto by addn. of methanol) |
|---|---|---|---|
| $AgNO_3$ | 100.0 g | — | — |
| KBr | — | 56.0 g | — |
| NaCl | — | 7.2 g | — |
| Dye (c) | — | — | 0.23 mg |

Emulsion (III):

The solution (I) and the solution (II) described below were simultaneously added over a 30-minute period at the same and constant flow rate to an aqueous gelatin solution (containing 20 g of gelatin, 3 g of potassium bromide and 0.3 g of $HO(CH_2)_2S(CH_2)_2S(CH_2)_{20}H$ in 800 ml of water, and kept at 60° C.) with thoroughly stirring. Then, the solution (III) and the solution (IV) described below were further added simultaneously over a 20-minute period at the same and constant flow rate. After the conclusion of the addition, 30 ml of a 1% water solution of potassium iodide was furthermore added. Subsequently, the dye solution described below was added.

After washing with water and desalting, 20 g of lime-processed ossein gelatin was added to the resulting emulsion. Then, the pH and the pAg of the emulsion were adjusted to 6.2 by NaOH and 8.5 by KBr, respectively. Thereafter, the emulsion was chemically sensitized by the addition of sodium thiosulfate, chloroauric acid and 4-hydroxy-6-methyl 1,3,3*a*,7-tetrazaindene under the optimum condition. Thus, 600 g of a monodisperse octahedral silver iodobromide emulsion having an average grain size of 0.45 μm was obtained.

| | Solution I (180 ml in toto by addn. of water) | Solution II (180 ml in toto by addn. of water) | Solution III (350 ml in toto by addn. of water) | Solution IV (350 ml in toto by addn. of water) |
|---|---|---|---|---|
| $AgNO_3$ | 30 g | — | 70 g | — |
| KBr | — | 20 g | — | 49 g |
| KI | — | 1.8 g | — | — |

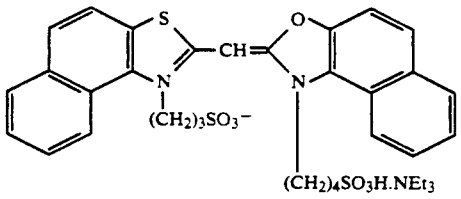

| | Yellow | Magenta | Cyan |
|---|---|---|---|
| Dye-providing Compound | (1) 13 g | (2) 16.8 g | (3) 14.5 g |
| Electron Donator (1) | 8.8 g | 8.6 g | 8.1 g |
| High Boiling Solvent (1) | 6.5 g | 8.4 g | 7.3 g |

As to the yellow dye-, the magenta dye- and the cyan dye-providing compounds independently, the above-described composition was added to 40 ml of cyclohexanone, and heated up to about 60° C. to be converted into a homogeneous solution. This solution was mixed with 100 g of a 10% water solution of lime-processed gelatin, 0.6 g of sodium dodecylbenzenesulfonate and 50 ml of water with stirring, and dispersed thereinto over a period of 10 minutes using a homogenizer rotating at 10,000 r.p.m. The thus obtained dispersion was called a gelatin dispersion of dye-providing compound.

Dye-Providing Compounds

-continued (1)

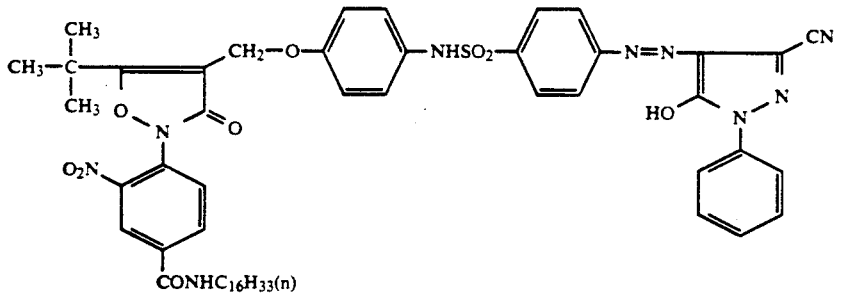

(2)

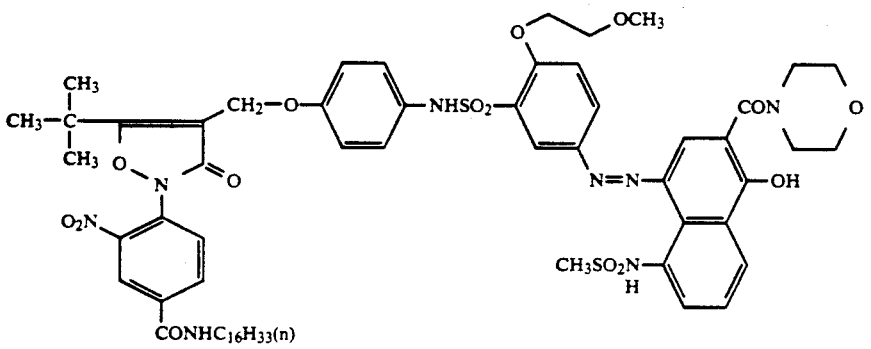

(3)

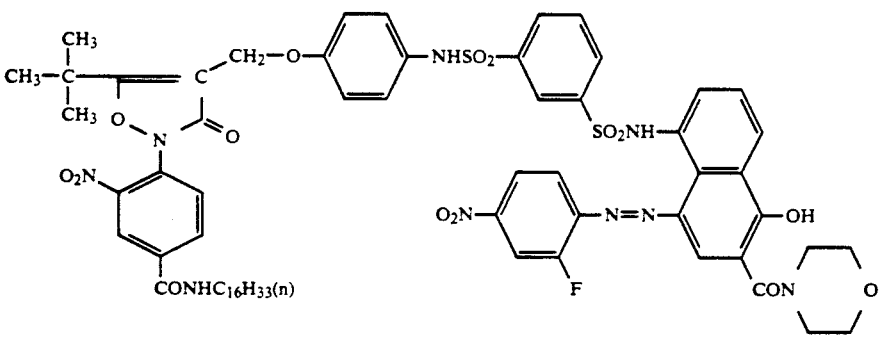

Electron Donator (1)

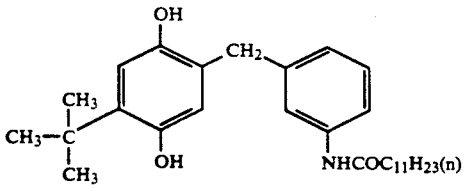

High Boiling (Organic) Solvent (1)

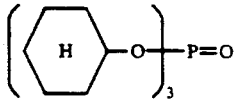

(3) Preparation of Dispersion of Zinc Hydroxide 12.5 g of zinc hydroxide having an average grain size of 0.2 μm, and as dispersants 1 g of carboxymethyl cellulose and 0.1 g of sodium polyacrylate were added to 100 ml of a 4% aqueous solution of gelatin, and ground to fine grains over a 30-minute period using glass beads of an average diameter of 0.75 mm in a mill. Then, the glass beads was removed therefrom, and a dispersion of zinc hydroxide was obtained.

A heat developable photosensitive material (1) having the multilayer structure described in Table 1 and capable of making a posi-posi response was produced using the emulsions and the dispersions prepared in the above-described manners.

TABLE 1

| | |
|---|---|
| Sixth Layer (protective layer) | gelatin (0.85 g/m$^2$), matting agent (silica) (0.03 g/m$^2$), water-soluble polymer (1) (0.23 g/m$^2$), surfactant (1) (0.06 g/m$^2$), surfactant (2) (0.13 g/m$^2$), |

TABLE 1-continued

| | |
|---|---|
| | hardener (1) (0.01 g/m$^2$), $ZnSO_4.7H_2O$ 0.06 g/m$^2$) |
| Fifth Layer (blue-sensitive layer) | Emulsion (III) (silver: 0.33 g/m$^2$), gelation (0.5 g/m$^2$), yellow dye-providing compound (1) (0.4 g/m$^2$), high boiling organic solvent (1) (0.2 g/m$^2$), electron donator (1) (0.27 g/m$^2$), surfactant (3) (0.05 g/m$^2$), electron transmitter (1) (0.03 g/m$^2$), hardener (1) (0.01 g/m$^2$), water-soluble polymer (2) (0.02 g/m$^2$) |
| Fourth Layer (interlayer) | gelatin (0.75 g/m$^2$), $Zn(OH)_2$ (0.32 g/m$^2$), reducing agent (1) (0.11 g/m$^2$), surfactant (1) (0.02 g/m$^2$), surfactant (4) (0.07 g/m$^2$), water-soluble polymer (2) (0.02 g/m$^2$), hardener (1) (0.01 g/m$^2$) |
| Third Layer (green-sensitive layer) | Emulsion (II) (silver: 0.2 g/m$^2$), gelatin (0.3 g/m$^2$), magenta dye-providing compound (2) (0.32 g/m$^2$), high boiling organic solvent (1) (0.16 g/m$^2$), electron donator (1) (0.16 g/m$^2$), surfactant (3) (0.04 g/m$^2$), electron transmitter (1) (0.03 g/m$^2$), hardener (1) (0.01 g/m$^2$), |

TABLE 1-continued

| | |
|---|---|
| | water-soluble polymer (2) (0.02 g/m$^2$) |
| Second Layer (interlayer) | gelatin (0.75 g/m$^2$), $Zn(OH)_2$ (0.31 g/m$^2$), reducing agent (1) (0.11 g/m$^2$), surfactant (1) (0.06 g/m$^2$), surfactant (4) (0.10 g/m$^2$), water-soluble polymer (2) (0.03 g/m$^2$), hardener (1) (0.01 g/m$^2$) |
| First Layer (red-sensitive layer) | Emulsion (I) (silver: 0.2 g/m$^2$), gelatin (0.3 g/m$^2$), cyan dye-providing compound (3) (0.3 g/m$^2$), high boiling organic solvent (1) (0.18 g/m$^2$), electron donator (1) (0.16 g/m$^2$), surfactant (3) 0.04 g/m$^2$), electron transmitter (1) (0.03 g/m$^2$), hardener (1) (0.01 g/m$^2$), water-soluble polymer (2) (0.02 g/m$^2$) |
| Support | (100 μm-thick polyethylene terephthalate film) |
| Backing Layer | carbon black (0.44 g/m$^2$), polyester (0.30 g/m$^2$), polyvinyl chloride (0.30 g/m$^2$) |

The additives set forth in Table 1, other than the above-illustrated ones, are shown below.

Water-soluble Polymer (1)

Sumikagel L-5 (H) (produced by Sumitomo Chemical Co., Ltd.)

Water-soluble Polymer (2)

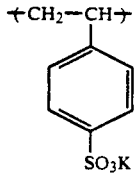

Surfactant (1)

Aerosol OT (produced by American Cyanamid)

Surfactant (2)

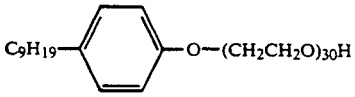

Surfactant (3)

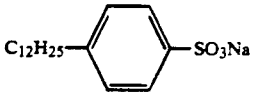

Surfactant (4)

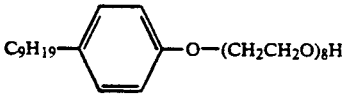

Hardener (1)

1,2-Bis(vinylsulfonylacetamido)ethane

Electron Transmitter (1)

-continued

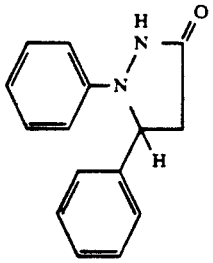

Reducing agent (1)

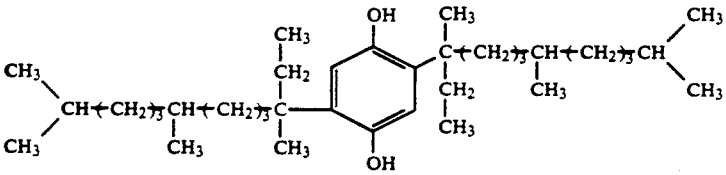

(4) Preparation of Dye-Fixing Material

On a paper support laminated with polyethylene were coated the layers described in Table 2 to prepare a dye-fixing material.

TABLE 2

| | |
|---|---|
| Third layer | gelatin (0.05 g/m$^2$), silicone oil (0.04 g/m$^2$), surfactant (1) (0.001 g/m$^2$), surfactant (2) (0.02 g/m$^2$), surfactant (3) (0.10 g/m$^2$), guanidinium picolinate (0.45 g/m$^2$), polymer (0.24 g/m$^2$) |
| Second Layer | mordant (2.35 g/m$^2$), polymer (2) (0.60 g/m$^2$), gelatin (1.40 g/m$^2$), high boiling solvent (1.40 g/m$^2$), guanidinium picolinate (1.80 g/m$^2$), surfactant (1) (0.02 g/m$^2$), polymer (1) (0.02 g/m$^2$) |
| First Layer | gelatin (0.45 g/m$^2$), surfactant (3) (0.01 g/m$^2$), polymer (0.04 g/m$^2$), hardener (0.30 g/m$^2$) |
| | Paper support laminated with polyethylene (thickness: 170 μm) |
| First Backing Layer | gelatin (3.25 g/m$^2$), hardener (0.25 g/m$^2$) |
| Second Backing Layer | gelatin (0.44 g/m$^2$), silicone oil (0.08 g/m$^2$), surfactant (1) (0.002 g/m$^2$), matting agent (0.09 g/m$^2$) |

The additives used are illustrated below.

Silicone Oil

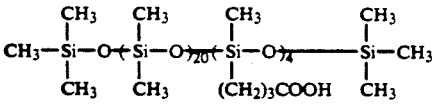

Surfactant (1)

Aerosol OT (produced by American Cyanamid)

Surfactant (2)

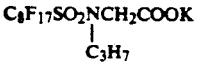

Surfactant (3)

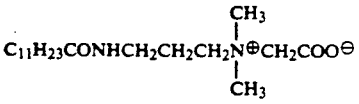

Polymer (1)

-continued

Vinyl alcohol/sodium acrylate copolymer (75/25 by mole)

Polymer (2)

Dextran (molecular weight: 70,000)

Mordant

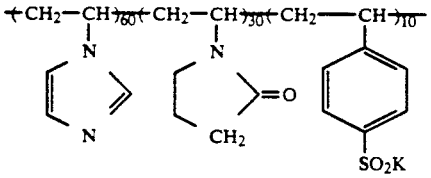

(Molecular weight: 200,000–500,000)

High Boiling Organic Solvent

Leophos 95 (produced by Ajinomoto Co., Inc. )

Hardener

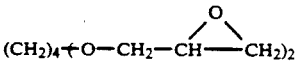

Matting Agent

Benzoguanamine resin (average particle size: 10 μm)

Photosensitive materials (2) and (3) (for comparison) each was prepared in the same manner as the photosensitive material (1), except that a conventional antifoggant shown in Table 3 was incorporated into the first, the third and the fifth layers. Further, photosensitive materials (4) to (15) (in accordance with this invention) were prepared in the same manner as the comparative samples, except that the compounds of this invention were incorporated instead of the conventional antifoggants, respectively. An amount of the antifoggant used in each layer was $2.5\times10^{-3}$ mole per mole of silver halide.

The conventional antifoggants used in the photosensitive materials (2) and (3) respectively are illustrated below.

Antifoggant A

-continued

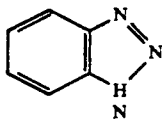

Antifoggant B

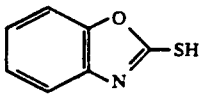

Each of the color photosensitive materials having the above-described multilayer structure was exposed to light emitted from a tungsten lamp through B, G, R and Gray color separation filters with continuously altered densities for 1/10 second under an illuminance of 4,000 lux.

Water was supplied to each emulsion face of the thus exposed photosensitive materials at a coverage of 15 $ml/m^2$ as each material was being conveyed at a linear speed of 20 mm per second, and immediately thereafter the wetted emulsion face was brought into a face-to-face close contact with the dye-fixing material.

The superposed materials were heated for 15 seconds with heating rollers whose temperature was controlled so that a temperature of the water-absorbed film might go up to 85° C.

Then, the photosensitive material was peel apart from the dye-fixing material. Thereupon, blue, green, red and gray images were obtained in the dye fixing material in correspondence to the B, G, R and Gray color separation filters.

A maximum density (Dmax), a minimum density (Dmim) and a sensitivity of each of cyan, magenta and yellow colors, in the gray area were determined. (The logarithm of the reciprocal of the exposure required for achieving the density of Dmin +0.5 was adopted in determining sensitivities. The sensitivities are shown as relative values with the comparative photosensitive material (1) being taken as 0.) The results obtained are shown in Table 3.

TABLE 3

| Photo-Sensitive Material No. | Anti-foggant No. | Yellow | | | Magenta | | | Cyan | | |
|---|---|---|---|---|---|---|---|---|---|---|
| | | Dmax | Dmin | Sensi-tivity | Dmax | Dmin | Sensi-tivity | Dmax | Dmin | Sensi-tivity |
| 1* | — | 1.21 | 0.16 | 0 | 1.62 | 0.16 | 0 | 1.13 | 0.14 | 0 |
| 2* | A | 1.22 | 0.16 | 0 | 1.66 | 0.16 | 0 | 1.15 | 0.14 | −0.05 |
| 3* | B | 1.76 | 0.26 | −0.25 | 2.21 | 0.20 | −0.30 | 1.89 | 0.21 | −0.65 |
| 4** | I-1 | 1.92 | 0.17 | +0.05 | 2.32 | 0.17 | +0.05 | 2.02 | 0.16 | +0.05 |
| 5** | I-2 | 1.88 | 0.16 | +0.05 | 2.23 | 0.17 | +0.10 | 1.98 | 0.15 | +0.05 |
| 6** | I-6 | 1.86 | 0.16 | +0.10 | 2.20 | 0.17 | +0.10 | 1.96 | 0.15 | +0.10 |
| 7** | I-12 | 1.91 | 0.17 | +0.15 | 2.30 | 0.17 | +0.20 | 2.01 | 0.16 | +0.25 |
| 8** | I-13 | 1.87 | 0.16 | +0.15 | 2.20 | 0.16 | +0.25 | 1.97 | 0.15 | +0.30 |
| 9** | I-21 | 1.90 | 0.17 | +0.05 | 2.31 | 0.17 | +0.05 | 2.00 | 0.16 | +0.05 |
| 10** | I-33 | 1.89 | 0.16 | +0.05 | 2.30 | 0.17 | +0.05 | 1.99 | 0.15 | +0.05 |
| 11** | II-1 | 1.90 | 0.17 | +0.05 | 2.30 | 0.17 | +0.05 | 2.00 | 0.16 | +0.05 |
| 12** | II-3 | 1.86 | 0.16 | +0.10 | 2.21 | 0.16 | +0.10 | 1.96 | 0.15 | +0.10 |
| 13** | II-19 | 1.84 | 0.16 | +0.10 | 2.18 | 0.16 | +0.10 | 1.94 | 0.15 | +0.10 |
| 14** | II-37 | 1.89 | 0.16 | +0.10 | 2.28 | 0.16 | +0.10 | 1.99 | 0.15 | +0.10 |
| 15** | II-42 | 1.85 | 0.16 | +0.10 | 2.18 | 0.16 | +0.10 | 1.97 | 0.15 | +0.10 |

*Comparison
**This invention

As can be clearly seen from the data of Table 3, the photosensitive materials of this invention were excellent in Dmax and Dmin, as well as sensitivity.

While the invention has been described in detail and with reference to specific embodiments thereof, it will be apparent to one skilled in the art that various changes and modifications can be made therein without departing from the spirit and scope thereof.

What is claimed is:

1. An image forming method which comprises the steps of:

imagewise exposing a heat developable photosensitive material which comprises a support having thereon at least one photosensitive silver halide, a reducing agent, a binder, and a compound represented by the general formula (I) or (II) in the same layer or in separate layers:

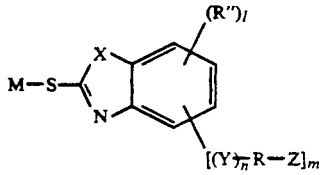

(I)

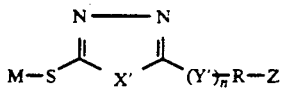

(II)

wherein R represents a substituted or unsubstituted alkylene group; Y represents

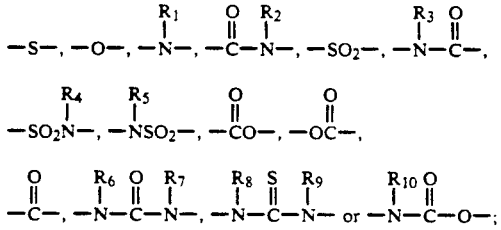

$R_1$, $R_2$, $R_3$, $R_4$, $R_5$, $R_6$, $R_7$, $R_8$, $R_9$ and $R_{10}$ each represents a hydrogen atom, or a substituted or unsubstituted alkyl, aryl, alkenyl or aralkyl group; X represents $$-O-,\ -\overset{R'}{\overset{|}{N}}-\ \text{or}\ -S-;$$

R' represents a hydrogen atom, or a substituted or unsubstituted alkyl or alkenyl group; R'' represents a hydrogen atom, or a substitutive group therefor; M represents a hydrogen atom, an alkali metal ion, an ammonium group, or a group capable of being cleaved under alkaline condition; n represents 0 or 1; m represents 1 or 2; l represents 4-m, Z in formula (I) represents a methoxy or ethoxy group or a substituted or unsubstituted amino, quaternary ammonium, sulfonyl, carbamoyl, sulfamoyl, carbonamido, sulfonamido, ureido, alkylthio, or heterocyclic group; Z in formula (II) represents a substituted or unsubstituted amino, quaternary ammonium, sulfonyl, carbamoyl, sulfamoyl, carbonamido, sulfonamido, ureido, alkylthio, alkoxy or heterocyclic group: X' represents —O—, —S—, Or —NH—; Y' represents $$-S-,\ -\overset{R_{11}}{\overset{|}{N}}-,\ -\overset{R_{12}}{\overset{|}{N}}-\overset{O}{\overset{\|}{C}}-\overset{R_{13}}{\overset{|}{N}}-,\ -\overset{R_{14}}{\overset{|}{N}}-\overset{S}{\overset{\|}{C}}-\overset{R_{15}}{\overset{|}{N}}-,$$

$$-\overset{R_{16}}{\overset{|}{N}}-\overset{O}{\overset{\|}{C}}-O-,\ -\overset{R_{17}}{\overset{|}{N}}-\overset{O}{\overset{\|}{C}}-,\ \text{or}\ -\overset{R_{18}}{\overset{|}{N}}-SO_2-;$$

$R_{11}$, $R_{12}$, $R_{13}$, $R_{14}$, $R_{15}$, $R_{16}$, $R_{17}$ and $R_{18}$ each has the same meaning as $R_1$ to $R_{10}$;

and heat developing the exposed photosensitive material in the presence of a solvent in an amount less than the weight of that solvent having a volume equivalent to the maximum swelling volume of all of the layers coated.

2. The method as claimed in claim 1, wherein Y is $$-\overset{O}{\overset{\|}{C}}-\overset{R_2}{\overset{|}{N}}-,\ -\overset{R_3}{\overset{|}{N}}-\overset{O}{\overset{\|}{C}}-,\ -\overset{R_5}{\overset{|}{N}}-SO_2-\ \text{or}\ -\overset{R_6}{\overset{|}{N}}-\overset{O}{\overset{\|}{C}}-\overset{R_7}{\overset{|}{N}}-,$$

wherein each of $R_2$, $R_3$, $R_4$, $R_5$, $R_6$ and $R_7$ is a hydrogen atom.

3. The method as claimed in claim 1, wherein S is —S— or —O—.

4. The method as claimed in claim 1, wherein R'' is a hydrogen atom, a halogen atom, an alkyl group or an alkoxy group.

5. The method as claimed in claim 1, wherein M in the general formula (I) is a hydrogen atom, a sodium ion, a potassium ion or an ammonium group.

6. The method as claimed in claim 1, wherein n in the general formula (I) is 1.

7. The method as claimed in claim 1, wherein m is 1.

8. The method as claimed in claim 1, wherein l is 1.

9. The method as claimed in claim 1, wherein Z in the general formula (I) is a substituted or unsubstituted amino group or a salt thereof, an alkylthio group substituted by an amino group, or a nitrogen-containing heterocyclic group.

10. The method as claimed in claim 1, wherein Y is —S— or $$-\overset{R_{14}}{\overset{|}{N}}-\overset{O}{\overset{\|}{C}}-\overset{R_{15}}{\overset{|}{N}}-,$$

wherein $R_{14}$ and $R_{15}$ are both a hydrogen atom.

11. The method as claimed in claim 1, wherein X is —S— or —O—.

12. The method as claimed in claim 1, wherein M in the general formula (II) is a hydrogen atom, a sodium ion, a potassium ion or an ammonium group.

13. The method as claimed in claim 1, wherein n in the general formula (II) is 1.

14. The method as claimed in claim 1, wherein Z in the general formula (II) is a substituted or unsubstituted amino group, a salt thereof, an alkylthio group, or a heterocyclic group.

15. The method as claimed in claim 1, wherein said heat developable photosensitive material contains at least one compound selected from those represented by the general formula (I).

16. The method as claimed in claim 1, wherein Y is $$-\overset{R_6}{\overset{|}{N}}-\overset{O}{\overset{\|}{C}}-\overset{R_7}{\overset{|}{N}}-.$$

17. The method as claimed in claim 1, wherein Z is a substituted or unsubstituted amino group or a salt thereof, or an alkylthio group substituted by an amino group.

18. The method as claimed in claim 1, wherein said at least one compound is incorporated in a photosensitive layer or an adjacent layer thereof.

19. The method as claimed in claim 1, wherein said at least one compound is incorporated in a photosensitive layer.

20. The method as claimed in claim 1, wherein the amount of said at least one compound used ranges from $10^{-6}$ to 1 mole per mole of photosensitive silver halide.

21. The method as claimed in claim 1, wherein the amount of said at least one compound used ranges from $10^{-4}$ to $10^{-1}$ mole per mole of photosensitive silver halide.

22. The method as claimed in claim 1, wherein a coverage of photosensitive silver halide is from 1 $mg/m^2$ to 10 $g/m^2$ based on the silver.

* * * * *